US005636841A

United States Patent [19]

Burroughs

[11] Patent Number: 5,636,841

[45] Date of Patent: Jun. 10, 1997

[54] CHECKER GAME USING CUBE SHAPED CHECKER PIECES

[76] Inventor: Robert C. Burroughs, 20400 Frederick Rd., Lot 1-2, Germantown, Md. 20876

[21] Appl. No.: 526,326

[22] Filed: Sep. 11, 1995

[51] Int. Cl.[6] ..... A63F 3/02

[52] U.S. Cl. ..... 273/260; 273/288; 273/291

[58] Field of Search ..... 273/260, 288, 273/291, 261

[56] References Cited

U.S. PATENT DOCUMENTS

| | | | |
|---|---|---|---|
| 788,101 | 4/1905 | Gross | 273/288 |
| 817,233 | 4/1906 | Emmerling | 273/260 |
| 3,588,114 | 6/1971 | Vogel | 273/291 |
| 4,289,314 | 9/1981 | Berlino | 273/260 |

*Primary Examiner*—Benjamin H. Layno

[57] ABSTRACT

This invention relates to a checkers type game that incorporates the use of cube shaped checker pieces having individual identifying numbers from one to six on each of its side faces which enables the player on a given turn to reposition a selected checker piece to a higher and more authoritative number which adds a new dimension of play to the game.

4 Claims, 1 Drawing Sheet

CHECKER GAME USING CUBE SHAPED CHECKER PIECES

SUMMARY OF THE INVENTION

This game was designed to introduce a new and unique dimension to the well known game of checkers which in turn provides a wider range of strategy. Heretofore, checkers basically performed a function of either moving from one square to another or jumping an opponent's checker, with the only increase in authority of a given checker being achieved by successfully moving to the opposing edge of the board known as the king's row. This achievement would give this checker the authoritative power of a "king" to move backwards as well as forward instead of previously being allowed to only move forward.

With Cube Checkers the game starts with each player's 12 checkers being positioned with number 1 face up. Each player has two separate moves, (1) his move of one checker to another square or a jump move and (2) his roll over move where he rolls over one of his other checkers to its next highest number. The purpose of the roll over move is to increase the authoritative power of the checker he rolled over because one given checker cannot jump another unless its face up value is equal to or higher than the face up value of the checker to be jumped. In conventional checkers there are only two stages of authoritative power, (1) the authoritative power of the single checker and (2) the authoritative power of the double checker which identifies as a king.

With Cube Checkers there are six stages of authoritative power determined by the face up number on the individual checker. Also, when a checker has been continuously rolled over until it reaches the number 6 it automatically becomes a king and does not have to reach the king row. On the other hand a checker that reaches the king row immediately rolls over to number 6 and becomes a king regardless of its previous high number.

The final goal of the game remains the same as with conventional checkers, namely, to win by jumping your opponent's last checker or making it impossible for him to move.

The advantage of having the roll over moves is that the player quickly becomes aware that there can be more to checkers than the mere moving from one square to another. The roll over moves open up a new dimension that provides more depth and strategy and broadens the scope of play.

A further object of the game is to provide a means to offer individual checkers a different type of authoritative power than what is now available through conventional checker and chess games.

A further object of the game is to provide a new element of play in the form of roll over moves that function independently of the moves from one square to another.

A further object of the game is to provide creative and coordinating strategy through the tandem moves.

Other objects and advantages will become apparent from a consideration of the following description and the appended claims in conjunction with the accompanying drawings wherein:

DESCRIPTION OF THE PREFERRED EMBODIMENTS

Figure 1:
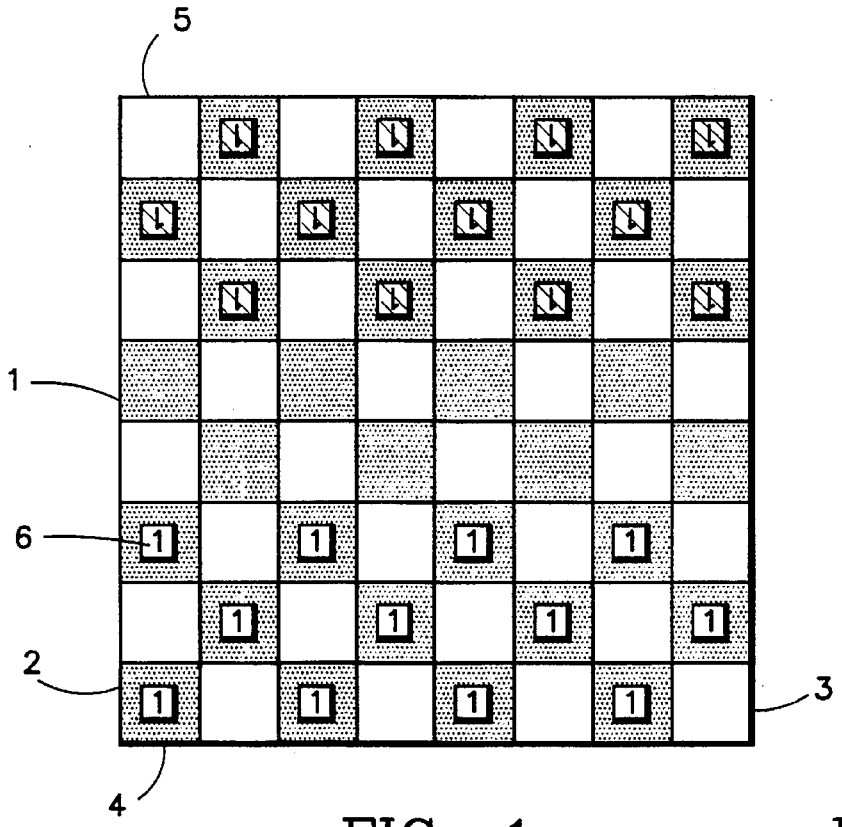
FIG. 1 is a top plan view of the checkerboard with its numbered cube checkers revealing each of said numbered cube checkers positioned with the number 1 face up at the start of the game.
Figure 2:
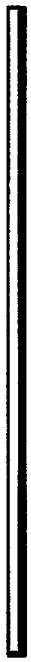
FIG. 2 is a side elevation view showing the edge of the checkerboard.

With continued reference to the drawings FIG. 1 represents a top plan view of the checkerboard 1 having horizontally and vertically disposed lines creating 8 vertical and 8 horizontal rows of 64 squares.

The first horizontal row of checkered squares begins at 2 and terminates at 3.

The first vertical row of checkered squares begins at 4 and terminates at 5. The checker pieces are divided into two distinguishable sets, one set of checker pieces for each player. The each set of checker pieces has opposing visually identifiable properties (e.g. different colors, made of visually different material, etc.) to clearly distinguish one set of checker pieces from the other set of checker pieces.

The checkers are positioned by each player at the start of the game in the first three rows from the lower edge of the checkerboard relative to and adjacent to each player's sitting position as outlined in FIG. 1.

At the start of the game each and every cube checker is positioned face up at its Initial number 1 as indicated at 6, and will roll over to higher face up numbers as the roll over moves occur and reoccur during the progress of the game.

Figure 3:
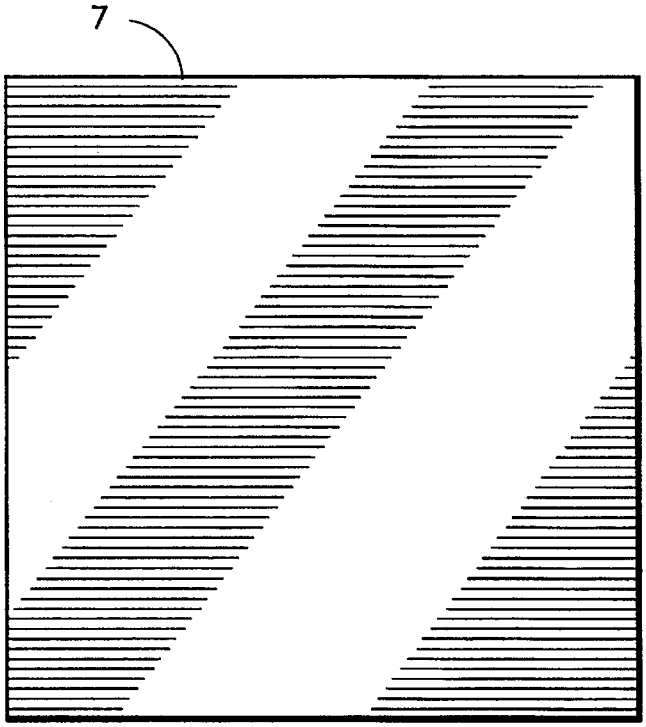
FIG. 3 is a bottom plan view of the checkerboard.

The reverse side 7 of the checkerboard 1 is shown in FIG. 3.

Figure 4:
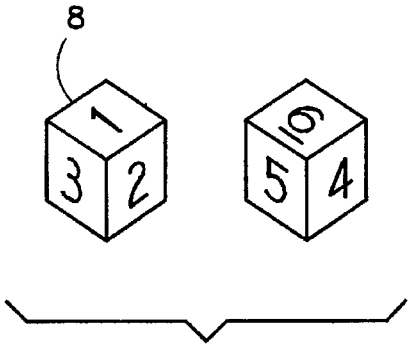
FIG. 4 is a perspective view of one of the cube shaped checker components.

A numbered cube checker 8 is shown in detail in FIG. 4.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A checker game comprising:

a game board, said game board having a playing surface divided into a matrix of a plurality of spaces, said plurality of spaces alternatingly colored with only two different colors to form a checkered layout, and a plurality of checker pieces, said checker pieces divided into a first set of checker pieces and a second set of checker pieces, one set of checker pieces for each player, said first and second sets of checker pieces having opposing visually identifiable properties to distinguish said first set of checker pieces from said second set of checker pieces, each of said checker pieces shaped in the form of a geometrical configuration with at least six side faces, and each side of said six side faces of each checker piece having an indicia identification, wherein each checker piece having a different indicia identification on each side of its six side faces distinguishing each side face of a checker piece from any of its other sides, and said six sides of each of said checker pieces having the same said different indicia identification.

2. The checker game as described in claim 1, wherein each side of said six sides of each of said checker pieces having only one indicia identification.

3. The checker game as described in claim 1, wherein said different indicia identification is a different numerical quantity.

4. The checker game as described in claim 1, wherein said geometrical configuration of said checker pieces being cube shaped.

* * * * *